US006826780B1

(12) United States Patent
Romesburg

(10) Patent No.: US 6,826,780 B1
(45) Date of Patent: Dec. 7, 2004

(54) CLOTHING PROTECTION SYSTEM

(76) Inventor: Daniel R. Romesburg, 1816 Rebecca Rd., Lutz, FL (US) 33549

( * ) Notice: Subject to any disclaimer, the term of this patent is extended or adjusted under 35 U.S.C. 154(b) by 458 days.

(21) Appl. No.: 09/849,700

(22) Filed: May 7, 2001

(51) Int. Cl.[7] ..... A41D 13/04; A41B 13/10
(52) U.S. Cl. ..... 2/49.2; 2/48
(58) Field of Search ..... 2/48, 49.1, 49.2, 2/49.3, 49.4, 49.5, 50, 51, 52, 46, 102; D2/861, 863, 864; 297/464, 465, 468, 482, 483, 487; 224/275; 280/801.1, 808, 748, 749, 751

(56) References Cited

U.S. PATENT DOCUMENTS 2,265,690 A * 12/1941 Fiedler ..... 2/48
2,697,223 A * 12/1954 Geisinger ..... 2/52
2,948,037 A * 8/1960 Bugyi ..... 24/698.3
4,114,199 A * 9/1978 Malan ..... 2/49.3
4,649,572 A * 3/1987 Roessler ..... 2/49.2
4,660,224 A * 4/1987 Ashcraft ..... 2/48
4,660,226 A * 4/1987 Quilling et al. ..... 2/49.2
4,946,094 A * 8/1990 Stang ..... 224/270
5,107,545 A * 4/1992 Potter ..... 2/46
5,220,692 A * 6/1993 Cox ..... 2/48
5,285,940 A * 2/1994 Goulter ..... 224/148.4
5,621,916 A * 4/1997 Bell ..... 2/48
5,701,605 A * 12/1997 Bowen ..... 2/49.1
5,956,763 A * 9/1999 Blackshear ..... 2/49.1
5,960,472 A * 10/1999 Reid ..... 2/48
6,243,869 B1 * 6/2001 Ekovich ..... 2/48
6,317,890 B1 * 11/2001 Kuhn ..... 2/52
6,334,220 B1 * 1/2002 Frye ..... 2/49.2
6,557,895 B2 * 5/2003 Haack et al. ..... 280/801.1

* cited by examiner

*Primary Examiner*—A. Vanatta
(74) *Attorney, Agent, or Firm*—Edward P. Dutkiewicz

(57) ABSTRACT

A clothing protection system comprises a generally flat rectangular bib portion. The bib portion has a front face and a rear face. The rear face has a top edge. The rear face has a bottom edge. A pair of parallel side edges is provided between the top edge and bottom edge. A generally rectilinear receptacle portion is provided. The receptacle portion has a base face. The base face has an inner edge. The base face has an outer edge. The inner edge is coupled to the bottom edge of the bib portion. The receptacle portion has a front face coupled to the outer edge of the base. A pair of side faces is coupled between the base face, the front face and the bib portion. The side faces have creases. Attaching components are also provided.

6 Claims, 3 Drawing Sheets

CLOTHING PROTECTION SYSTEM

BACKGROUND OF THE INVENTION

1. Field of the Invention

The present invention relates to a clothing protection system and more particularly pertains to preventing food and other items from being spilt on the clothing of a user while in a vehicle.

2. Description of the Prior Art

The use of bibs and related clothing protectors of known designs and configurations is known in the prior art. More specifically, bibs and related clothing protectors of known designs and configurations previously devised and utilized for the purpose of abating the soiling of clothing from food and drink by conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,621,916 to Bell discloses a bib for use while operating a vehicle. U.S. Pat. No. 5,956,763 to Blackshear discloses a disposable bib with lap protector. U.S. Pat. No. 5,220,692 to Cos discloses a driver's apron. U.S. Pat. No. Des. 311,445 to Dawahare discloses a disposable bib for motor vehicle occupants. U.S. Pat. No. 5,181,275 to Spulgis discloses an apron to be used in a seated position. Lastly, U.S. Pat. No. 4,170,991 to Kella discloses a seat bib.

While these devices fulfill their respective, particular objectives and requirements, the aforementioned patents do not describe a clothing protection system that allows for the prevention of food and other items from being spilt on the clothing of a user while in a vehicle.

In this respect, the clothing protection system according to the present invention substantially departs from the conventional concepts and designs of the prior art, and in doing so provides an apparatus primarily developed for the purpose of preventing food and other items from being spilt on the clothing of a user while in a vehicle.

Therefore, it can be appreciated that there exists a continuing need for a new and improved clothing protection system which can be used for preventing food and other items from being spilt on the clothing of a user while in a vehicle. In this regard, the present invention substantially fulfills this need.

SUMMARY OF THE INVENTION

In view of the foregoing disadvantages inherent in the known types of bibs and related clothing protectors of known designs and configurations now present in the prior art, the present invention provides an improved clothing protection system. As such, the general purpose of the present invention, which will be described subsequently in greater detail, is to provide a new and improved clothing protection system and method which has all the advantages of the prior art and none of the disadvantages.

To attain this, the present invention essentially comprises a vehicle safety belt. The safety belt has a shoulder strap extending across the body of a user. Next provided is a generally flat rectangular bib portion. The bib portion is of a washable synthetic fabric. The bib portion has a front face. The bib portion also has a rear face. A top edge and a bottom edge are provided. Provided between the bottom and top edges is a pair of parallel side edges. Further provided is a generally rectilinear receptacle portion. The receptacle portion has a base face. The base face has an inner edge and an outer edge. The inner edge is coupled to the bottom edge of the bib portion. The receptacle portion has a front face. The front face is coupled to the outer edge of the base. A pair of side faces is coupled between the base face, the front face and the bib portion. The side faces have creases. In this manner the faces of the receptacle portion may be used for storage purposes. The components of the receptacle portion in combination with the bib portion form an open pocket to catch any food and other spilled items that are not caught on the bib portion. Last provided are attaching components. The attaching components include two crossing straps. Each crossing strap has a first end. Each first end is coupled to the rear face of the bib portion adjacent to the upper edge. Each crossing strap also has a second end. Each second end has a first pile-type fastener. Each second end also has a second pile-type faster. Each second pile-type fastener is attached to the rear face of the bib portion. The fasteners are adapted to releasably couple the second end of the straps with the bib portion. Such attaching components enable a user to releasably couple the system to the shoulder strap of their vehicle safety belt during operation and use by a person in the vehicle, in any location, while eating to thereby prevent food from soiling the clothing of a user.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved clothing protection system which has all of the advantages of the prior art bibs and related clothing protectors of known designs and configurations and none of the disadvantages.

It is another object of the present invention to provide a new and improved clothing protection system which may be easily and efficiently manufactured and marketed.

It is further object of the present invention to provide a new and improved clothing protection system which is of durable and reliable constructions.

An even further object of the present invention is to provide a new and improved clothing protection system which is susceptible of a low cost of manufacture with regard to both materials and labor, and which accordingly is then susceptible of low prices of sale to the consuming public, thereby making such clothing protection system economically available to the buying public.

Even still another object of the present invention is to provide a clothing protection system for preventing food and other items from being spilt on the clothing of a user while in a vehicle.

Lastly, it is an object of the present invention to provide a new and improved clothing protection system comprising a generally flat rectangular bib portion. The bib portion has a front face and a rear face. The rear face has a top edge. The rear face has a bottom edge. A pair of parallel side edges is provided between the top edge and bottom edge. A generally rectilinear receptacle portion is provided. The receptacle portion has a base face. The base face has an inner edge. The base face has an outer edge. The inner edge is coupled to the bottom edge of the bib portion. The receptacle portion has a front face coupled to the outer edge of the base. A pair of side faces is coupled between the base face, the front face and the bib portion. The side faces have creases. Attaching components are also provided.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
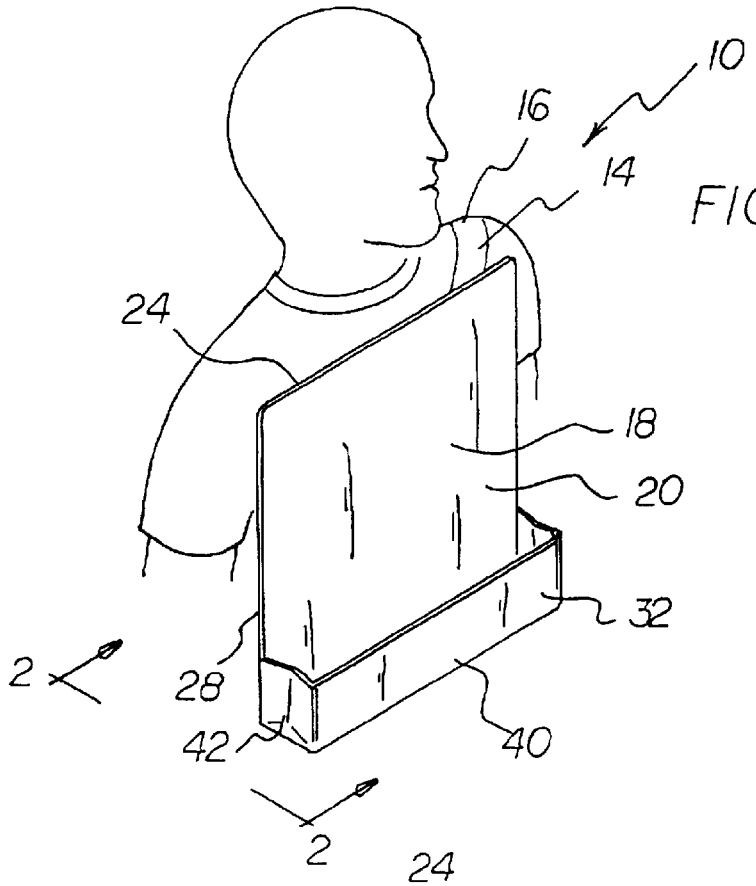
FIG. 1 is a perspective illustration of the clothing protection system constructed in accordance with the principles of the present invention.
Figure 2:
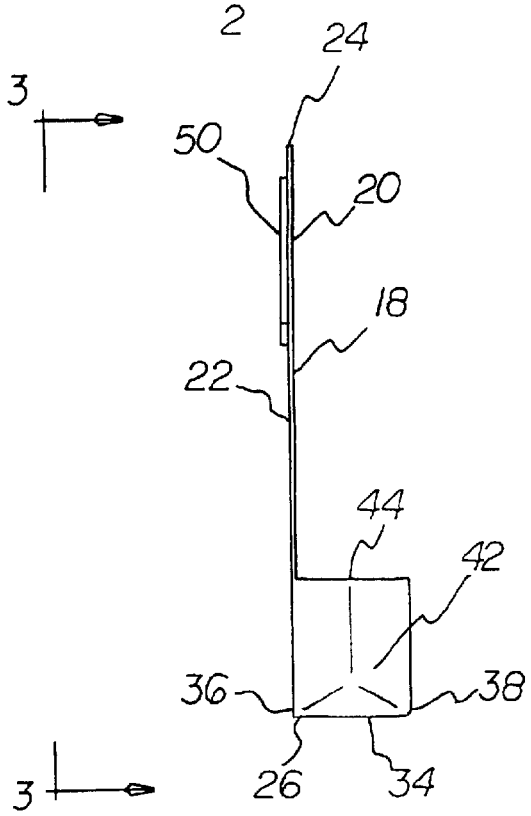
FIG. 2 is a side elevational view of the present invention taken along line 2—2 of FIG. 1.
Figure 3:
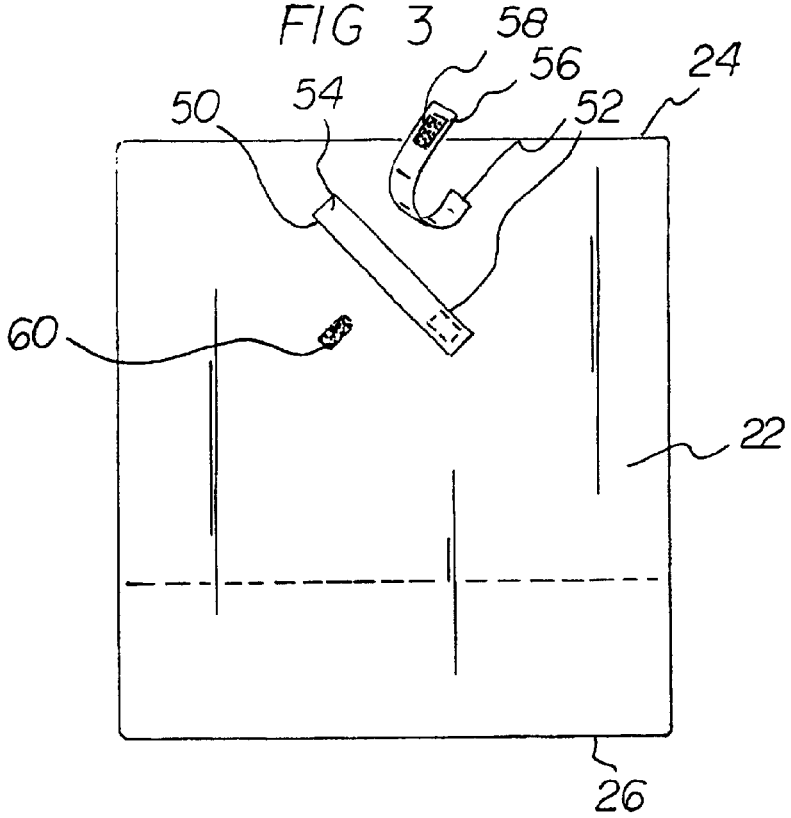
FIG. 3 is a rear elevational view illustrating the attachment components of the present invention taken along line 3—3 of FIG. 2.
Figure 4:
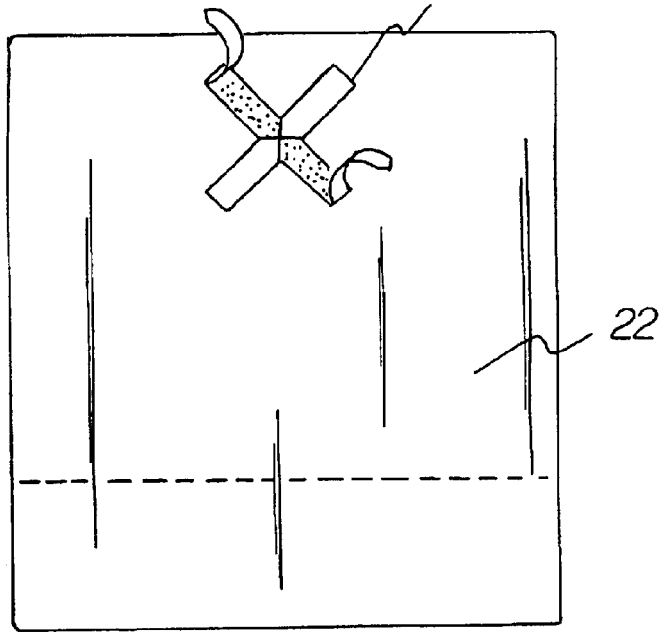
FIG. 4 is a rear elevational view of an alternate embodiment of the present invention taken along line 3—3 of FIG. 2.

With reference now to the drawings, and in particular to FIG. 1 thereof, the preferred embodiment of the new and improved clothing protection system embodying the principles and concepts of the present invention and generally designated by the reference numeral 10 will be described.

The present invention, the clothing protection system 10 is comprised of a plurality of components. Such components in their broadest context include a generally flat rectangular bib portion, a generally rectilinear receptacle portion and attaching components. Such components are individually configured and correlated with respect to each other so as to attain the desired objective.

First provided is a vehicle safety belt 14. The safety belt has a shoulder strap 16 extending across the body of a user.

Next provided is a generally flat rectangular bib portion 18. The bib portion is of a washable synthetic fabric. The bib portion has a front face 20. The bib portion also has a rear face 22. A top edge 24 and a bottom edge 26 are provided. Provided between the bottom and top edges is a pair of parallel side edges 28.

Further provided is a generally rectilinear receptacle portion 32. The receptacle portion has a base face 34. The base face has an inner edge 36 and an outer edge 38. The inner edge is coupled to the bottom edge of the bib portion. The receptacle portion has a front face 40. The front face is coupled to the outer edge of the base. A pair of side faces 42 is coupled between the base face, the front face and the bib portion. The side faces have creases 44. In this manner the faces of the receptacle portion may be used for storage purposes. The components of the receptacle portion in combination with the bib portion form an open pocket 46 to catch any food and other spilled items that are not caught on the bib portion.

Last provided are attaching components 50. The attaching components include two crossing straps 52. Each crossing strap has a first end 54. Each first end is coupled to the rear face of the bib portion adjacent to the upper edge. Each crossing strap also has a second end 56. Each second end has a first pile-type fastener 58. Each second end also has a second pile-type faster 60. Each second pile-type fastener is attached to the rear face of the bib portion. The fasteners are adapted to releasably couple the second end of the straps with the bib portion. Such attaching components enable a user to releasably couple the system to the shoulder strap of their vehicle safety belt during operation and use by a person in the vehicle while eating to thereby prevent food from soiling the clothing of a user.

Figure 5:
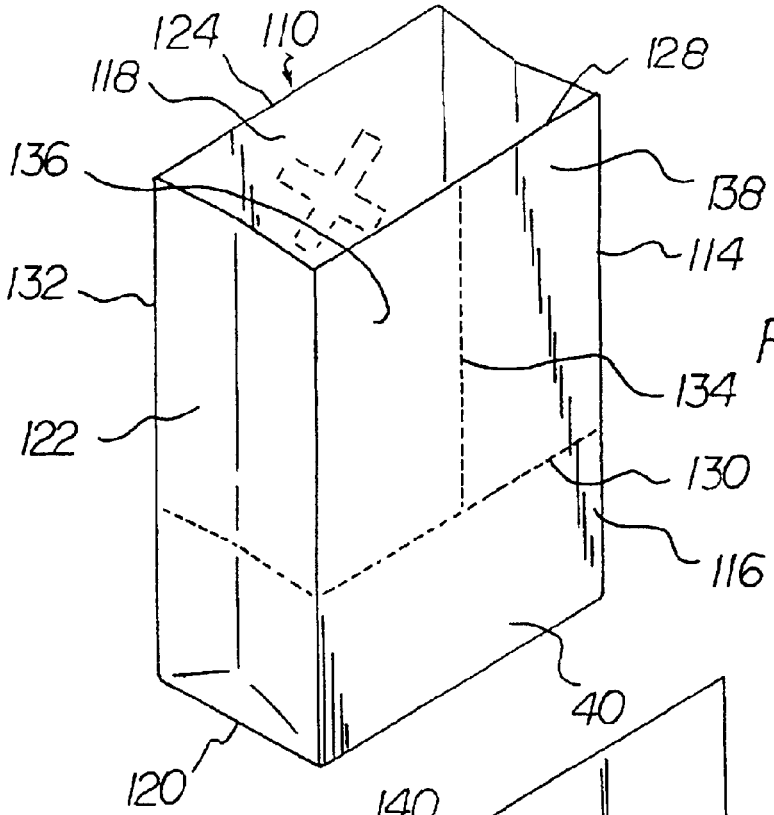
FIG. 5 is a side elevational view of another alternate embodiment of the present invention.
Figure 6:
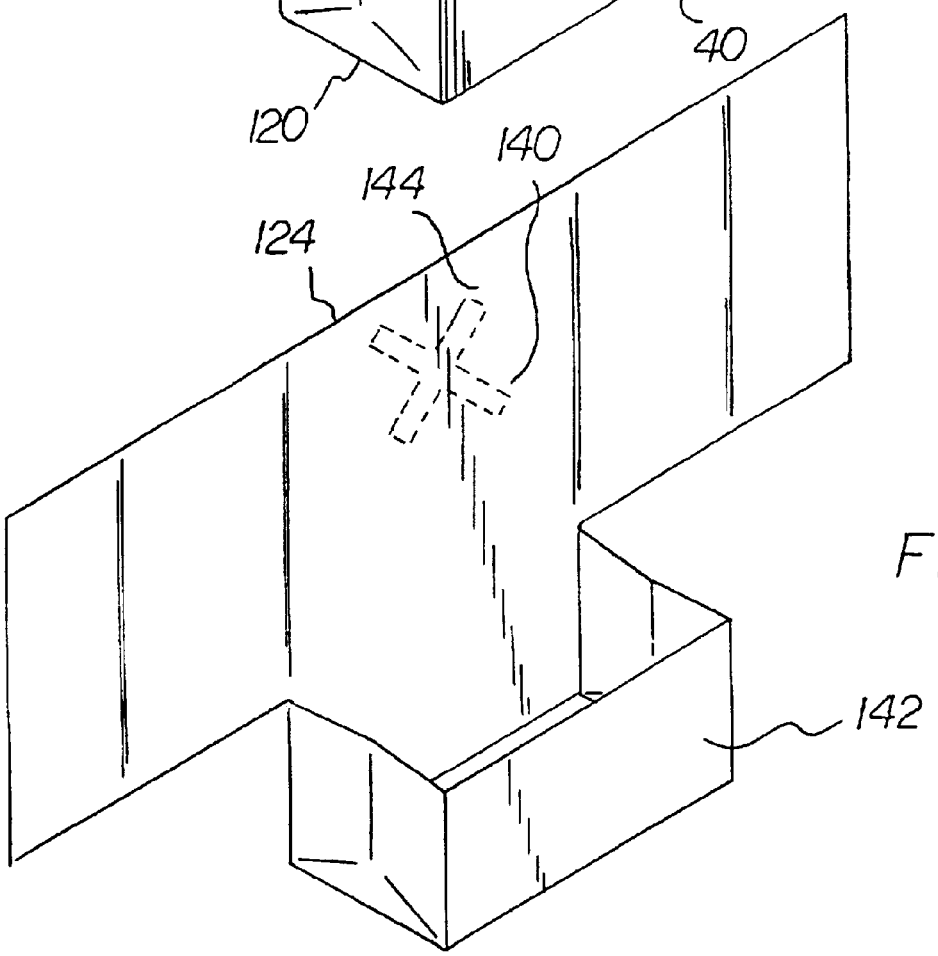
FIG. 6 is a side elevational view of an alternate embodiment of the present invention after the front portions have been removed.

FIGS. 5 and 6 illustrate an alternate embodiment of the present invention. This alternate embodiment is a conventional rectangular bag 114. The conventional rectangular bag is fabricated of paper. The bag has a front face 116. The bag has a back face 118. The bag also has a base face 120. Side faces 122 are provided between the front face, the back face and the base face. The back face has a top edge 124. The back face also has parallel side edges 126. The front face has a top edge 128. The bag has a first perforation 130. The first perforation runs in a horizontal line across the lower third of the front face and side faces. The bag has a pair of rearward fold lines 132. The rearward fold lines run from the horizontal line to the top edge along the side edges of the back face. The bag also has a second perforation 134. The second perforation runs vertically from the horizontal line to the top edge of the front face at an intermediate location. The perforated regions and rearward fold lines define two front portions 136, 138. When the front portions are separated along the perforations and folded outwardly the back face forms a bib portion 140 and the portion below the horizontal line forms a receptacle portion 142.

Also included in this alternate embodiment is an attaching component. The attaching component includes an x-shaped adhesive patch. The adhesive patch is covered by four similarly shaped removable strips 144 each covering one-quarter of the adhesive. The adhesive patch is attached to the rear face of the bag. Two of the four removable strips are selectively removed to expose only the adhesive in regions for contacting the safety harness in one angular orientation while the other two strips are removed to expose adhesive for a safety belt in the opposite angular orientation. The attaching component is adapted to couple the bag to a safety harness for use in a vehicle.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A clothing protection system for preventing food and other items from being spilt on the clothing of a user while in a vehicle comprising, in combination:

a vehicle safety belt having a shoulder strap extending across the body of a user;

a generally flat rectangular bib portion fabricated of a washable synthetic fabric having a front face and a rear face with a top edge, bottom edge, and a pair of parallel side edges there between;

a generally rectilinear receptacle portion having a base face with an inner edge and outer edge with the inner edge being coupled to the bottom edge of the bib portion, the receptacle portion having a front face coupled to the outer edge of the base and with a pair of side faces coupled between the base face and front face and the bib portion, the side faces having creases to facilitate the faces of the receptacle portion for storage purposes, the components of the receptacle portion in combination with the bib portion forming an open packet to catch any food and other spilled items that are not caught on the bib portions; and attaching components including two crossing straps each having a first end coupled to the rear face of the bib portion adjacent to the upper edge thereof and a second end with a first pile-type fastener and a second pile-type fastener attached to the rear face of the bib portion, adapted to releasably couple the second end of the straps with the bib portion, such attaching components enabling a user to releasably couple the system to the shoulder strap of their vehicle safety belt during operation and use by a person in the vehicle while eating to thereby prevent food from soiling the clothing of a user.

2. A clothing protection system comprising:

a vehicle safety belt with a shoulder strap positioned across the shoulder and front of a user;

a generally flat rectangular bib portion having a front face and a rear face with a top edge, bottom edge, and a pair of parallel side edges there between;

a generally rectilinear receptacle portion having a base face with an inner edge and outer edge with the inner edge being coupled to the bottom edge of the bib portion, the receptacle portion having a front face coupled to the outer edge of the base and with a pair of side faces coupled between the base face and front face and the bib portion, the side faces having creases; and attaching components coupled to the rear face of the bib portion at a location overlying, and in contact with, the safety belt.

3. The clothing protection system as set forth in claim 2 wherein the attachment human comprises two crossing straps to couple with the shoulder strap of the safety belt with the straps each having a first end coupled to the rear face of the bib portion adjacent to the upper edge thereof and a second end with a first pile-type fastener and a second pile-type fastener attached to the rear face of the bib portion.

4. The clothing protection system as set forth in claim 2 wherein the attachment means comprises an "X" shaped adhesive strip coupled adjacent to the upper edge of the bib portion.

5. The clothing protection system as set forth in claim 2 further wherein the bib portion and receptacle portion being fabricated of paper, the side edges of the bib and receptacle being defined by perforations.

6. The clothing protection system as set forth in claim 5 wherein the paper is coated in wax.

* * * * *